US010988913B2

(12) United States Patent
Graham et al.

(10) Patent No.: US 10,988,913 B2
(45) Date of Patent: Apr. 27, 2021

(54) BLADE FOR WORK VEHICLE

(71) Applicant: DEERE & COMPANY, Moline, IL (US)

(72) Inventors: Brett Graham, Dubuque, IA (US); Nilesh Kumbhar, Karad (IN); Nicholas Rokusek, Dubuque, IA (US); John Mahrenholz, Dubuque, IA (US); Michael Tigges, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 125 days.

(21) Appl. No.: 16/282,277

(22) Filed: Feb. 21, 2019

(65) Prior Publication Data

US 2020/0270842 A1 Aug. 27, 2020

(51) Int. Cl.

| | |
|---|---|
| ***E02F 3/76*** | (2006.01) |
| ***E02F 3/84*** | (2006.01) |
| ***E02F 3/815*** | (2006.01) |
| *E02F 3/96* | (2006.01) |

(52) U.S. Cl.

CPC ..... *E02F 3/7618* (2013.01); *E02F 3/7613* (2013.01); *E02F 3/815* (2013.01); *E02F 3/844* (2013.01); *E02F 3/96* (2013.01)

(58) Field of Classification Search

CPC ..... E02F 3/815; E02F 3/7613; E02F 3/7618; E02F 3/844; E02F 3/3604; E02F 3/3677; E02F 3/3686; E02F 3/96

See application file for complete search history.

(56) References Cited

U.S. PATENT DOCUMENTS 3,591,935 A * 7/1971 Bremmer ..... E02F 3/3604 37/407
3,913,684 A 10/1975 Casey et al.
4,405,019 A * 9/1983 Frisbee ..... E02F 3/7613 172/816

(Continued)

FOREIGN PATENT DOCUMENTS

CA 2885399 A1 9/2016
EP 0480036 A1 4/1992

(Continued)

OTHER PUBLICATIONS

German Search Report issued in counterpart application No. 102020202169.4 dated Nov. 5, 2020 (10 pages).

*Primary Examiner* — Jessica H Lutz

(57) ABSTRACT

A work vehicle comprising a frame supported by a ground engaging device. A boom assembly is coupled to the frame. A boom cylinder is coupled to the frame and the boom assembly. An attachment coupler is coupled to a distal portion of the boom assembly. At least one tilt cylinder is coupled to the boom assembly and the attachment coupler. An attachment is coupled to the attachment coupler. The attachment comprises an attachment frame coupled to the attachment coupler. The attachment frame has a lower portion and an upper portion. A joint is coupled to the lower portion of the attachment frame and a blade. The joint has an upper surface and a lower surface positioned a distance from the surface. An angle cylinder is coupled to the lower portion of the attachment frame and a blade. A portion of the angle cylinder is positioned below the upper surface.

17 Claims, 6 Drawing Sheets

(56) References Cited

U.S. PATENT DOCUMENTS

| | | | | |
|---|---|---|---|---|
| 5,403,144 | A * | 4/1995 | Staben, Jr. | E02F 3/3677 172/272 |
| 5,732,781 | A * | 3/1998 | Chambers | E02F 3/627 172/825 |
| 6,152,239 | A | 11/2000 | Kelley et al. | |
| 6,542,789 | B2 | 4/2003 | Ufheil | |
| 7,036,248 | B2 | 5/2006 | Meyeres et al. | |
| 7,099,722 | B2 | 8/2006 | Casey | |
| 7,451,840 | B2 | 11/2008 | Radke et al. | |
| 8,091,678 | B2 | 1/2012 | Rowan et al. | |
| 8,108,109 | B2 | 1/2012 | Young et al. | |
| 8,118,111 | B2 * | 2/2012 | Armas | E02F 3/7618 172/779 |
| 9,055,719 | B2 | 6/2015 | Bowman et al. | |
| 9,328,479 | B1 | 5/2016 | Rausch et al. | |
| 9,988,786 | B2 | 6/2018 | Martin et al. | |
| 10,533,300 | B1 | 1/2020 | Armas | |
| 2005/0000709 | A1 * | 1/2005 | Werner | E02F 3/7618 172/810 |
| 2006/0064221 | A1 | 3/2006 | Sporer et al. | |
| 2008/0083570 | A1 | 4/2008 | Bares et al. | |
| 2008/0300758 | A1 | 12/2008 | Young et al. | |
| 2009/0118844 | A1 | 5/2009 | Schmuck et al. | |
| 2009/0198414 | A1 | 8/2009 | Mohning et al. | |
| 2011/0067893 | A1 | 3/2011 | Liebl et al. | |
| 2015/0159342 | A1 | 6/2015 | Martin et al. | |
| 2016/0032564 | A1 | 2/2016 | Pinther, II et al. | |
| 2016/0230367 | A1 | 8/2016 | Hendron et al. | |
| 2016/0230368 | A1 | 8/2016 | Lee | |
| 2016/0273196 | A1 | 9/2016 | Funk et al. | |
| 2017/0089035 | A1 * | 3/2017 | Parker | E02F 3/964 |
| 2017/0145655 | A1 | 5/2017 | Mason | |
| 2017/0284316 | A1 | 10/2017 | Hansen et al. | |
| 2018/0058030 | A1 | 3/2018 | Shimomura et al. | |
| 2018/0058038 | A1 | 3/2018 | Fredrickson | |
| 2018/0106011 | A1 | 4/2018 | Kumbhar et al. | |
| 2018/0179735 | A1 | 6/2018 | Newlin et al. | |
| 2018/0238016 | A1 * | 8/2018 | Seacat | E02F 3/3414 |
| 2018/0245306 | A1 | 8/2018 | Lewis | |
| 2019/0226176 | A1 | 7/2019 | Smith et al. | |
| 2019/0257057 | A1 * | 8/2019 | Eckrote | E02F 3/96 |

FOREIGN PATENT DOCUMENTS

| | | | |
|---|---|---|---|
| EP | 1106741 | A1 | 6/2001 |
| EP | 2584102 | A2 | 4/2013 |
| EP | 2722445 | A1 | 4/2014 |
| EP | 3363955 | A2 | 8/2018 |
| WO | WO2015065703 | A1 | 5/2015 |

* cited by examiner

BLADE FOR WORK VEHICLE

FIELD OF THE DISCLOSURE

The present disclosure generally relates to work vehicles, such as skid steers, compact track loaders, and more particularly to a blade for a work vehicle.

BACKGROUND OF THE DISCLOSURE

In order to control grade of a surface for a variety of attachments having pitch, tilt, and angle adjustment interactions, multiple passes are commonly required to correct grade error due to the interactions.

SUMMARY OF THE DISCLOSURE

In one embodiment, a work vehicle is disclosed. The work vehicle comprises a frame. At least one ground engaging device is coupled to the frame and configured to support the frame above a surface. A boom assembly is coupled to the frame. At least one boom cylinder is coupled to the frame and the boom assembly and configured to move the boom assembly. An attachment coupler is coupled to a distal portion of the boom assembly. At least one tilt cylinder is coupled to the boom assembly and the attachment coupler and configured to move the attachment coupler. An attachment is coupled to the attachment coupler. The attachment comprises an attachment frame coupled to the attachment coupler. The attachment frame has a lower portion and an upper portion. The attachment further comprises a blade. A joint is coupled to the lower portion of the attachment frame and the blade. The joint has a lower surface and an upper surface. The upper surface is positioned a distance from the surface. At least one angle cylinder is coupled to the lower portion of the attachment frame and the blade. A portion of the angle cylinder is positioned below the upper surface of the joint.

In another embodiment, a compact track loader is disclosed. The compact track loader comprises a frame. At least one ground engaging device is coupled to the frame and configured to support the frame above a surface. A boom assembly is coupled to the frame. At least one boom cylinder is coupled to the frame and the boom assembly and configured to move the boom assembly. An attachment coupler is coupled to a distal portion of the boom assembly. At least one tilt cylinder is coupled to the boom assembly and the attachment coupler and configured to move the attachment coupler. An attachment is coupled to the attachment coupler. The attachment comprises an attachment frame coupled to the attachment coupler. The attachment frame has a lower portion and an upper portion. The attachment further comprises a dozer blade. A joint is coupled to the lower portion of the attachment frame and the dozer blade. The joint has a lower surface and an upper surface. The upper surface is positioned a distance from the surface. At least one angle cylinder is coupled to the lower portion of the attachment frame and the dozer blade. A portion of the angle cylinder is positioned below the upper surface of the joint.

In yet another embodiment, a work vehicle is disclosed. The work vehicle comprises a frame. At least one ground engaging device is coupled to the frame and configured to support the frame above a surface. A boom assembly is coupled to the frame. At least one boom cylinder is coupled to the frame and the boom assembly and configured to move the boom assembly. An attachment coupler is coupled to a distal portion of the boom assembly. At least one tilt cylinder is coupled to the boom assembly and the attachment coupler and configured to move the attachment coupler. An attachment is coupled to the attachment coupler. The attachment comprises an attachment frame coupled to the attachment coupler. The attachment frame has a lower portion and an upper portion. The attachment further comprises a blade. A joint is coupled to the lower portion of the attachment frame and the blade. The joint has a lower surface and an upper surface, the upper surface is positioned a distance from the surface. A tilt cylinder is coupled to the upper portion of the attachment frame and the dozer blade. An adjustable linkage is coupled to the upper portion of the attachment frame and the dozer blade. At least one angle cylinder is coupled to the lower portion of the attachment frame and the blade. A portion of the angle cylinder is positioned below the upper surface of the joint.

Other features and aspects will become apparent by consideration of the detailed description and accompanying drawings.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Further embodiments of the invention may include any combination of features from one or more dependent claims, and such features may be incorporated, collectively or separately, into any independent claim.

As used herein, unless otherwise limited or modified, lists with elements that are separated by conjunctive terms (e.g., "and") and that are also preceded by the phrase "at least one of" or "one or more of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

DETAILED DESCRIPTION

Figure 1:
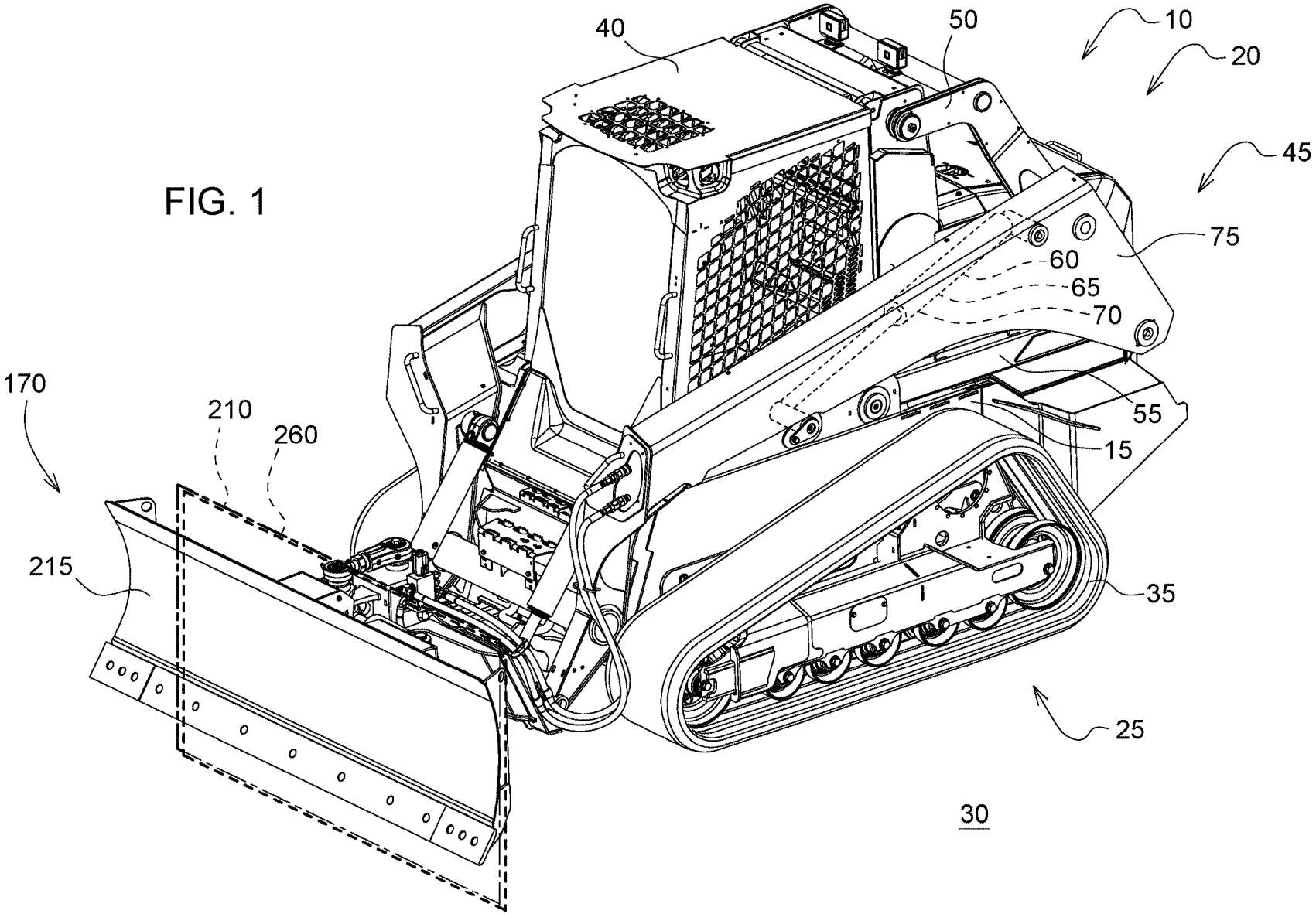
FIG. 1 is a perspective view of a work vehicle with a blade.

FIG. 1 illustrates a work vehicle 10 having a frame 15. The work vehicle 10 is illustrated as a compact track loader 20. Other types of work vehicles 10 are contemplated by this disclosure including skid steers and bulldozers, for example. At least one ground engaging device 25 is coupled to the frame 15 and configured to support the frame 15 above a surface 30 and to move the work vehicle 10 along the surface 30. The illustrated ground engaging device 25 is a pair of tracks 35. Alternatively, the ground engaging device 25 may be wheels (not shown).

An operator's station 40 is coupled to the frame 15. The operator's station 40 may have a door (not shown).

A boom assembly 45 is coupled to the frame 15. The boom assembly 45 comprises a pair of upper links 50 that are coupled to the frame 15. A pair of lower links 55 are coupled to the frame 15. A pair of boom cylinders 60 are coupled to the frame 15 with one per side of the work vehicle 10. The boom cylinders 60 may be hydraulic actuators 65 or electronic actuators 70. A pair of boom arms 75 are coupled to the upper links 50 and the lower links 55 and positioned one per side of the work vehicle 10. The pair of boom arms 75 are coupled to the boom cylinders 60. The boom cylinders 60 are configured to move the boom assembly 45.

Figure 2:
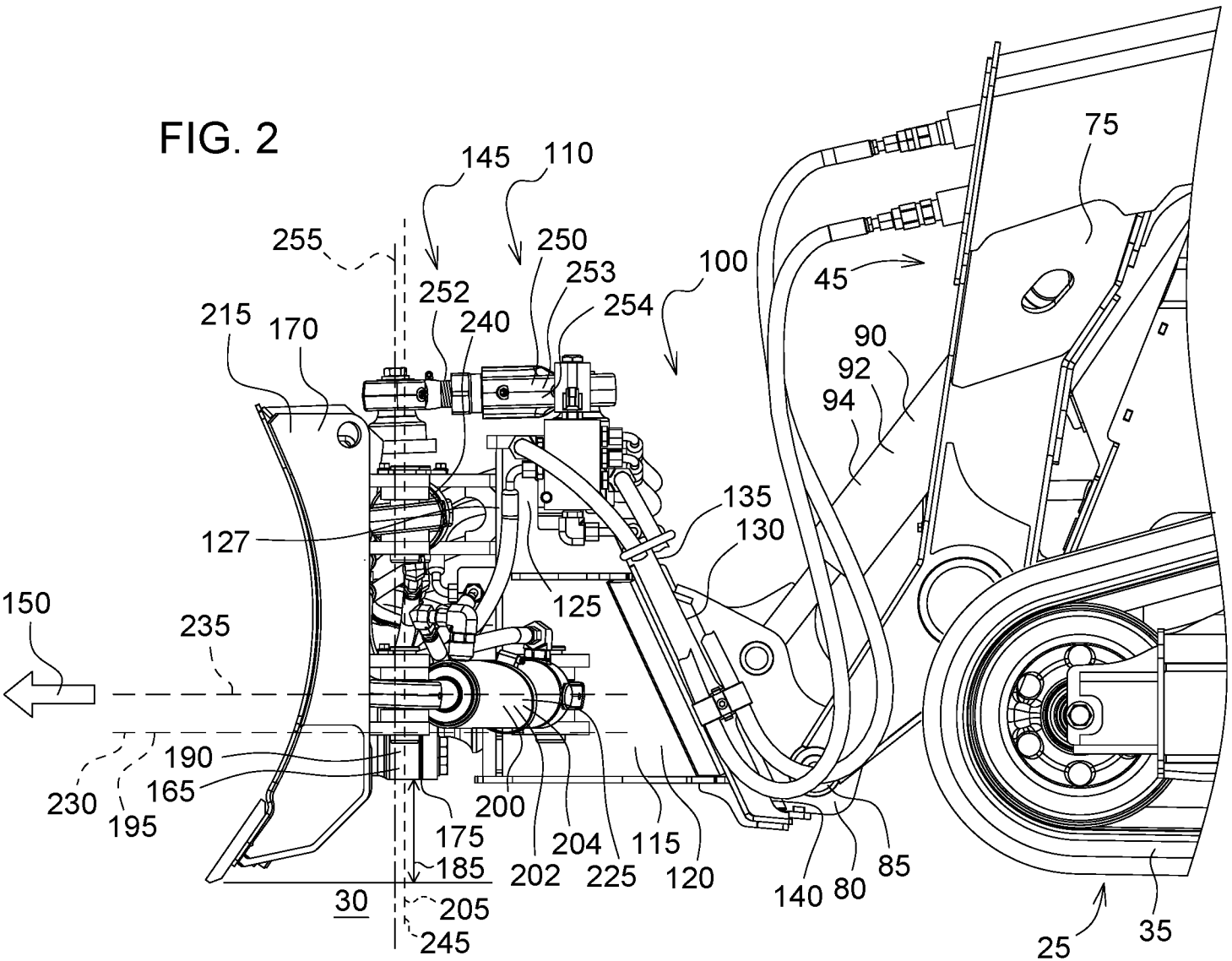
FIG. 2 is a zoomed in partial side view of the work vehicle of FIG. 1.
Figure 3:
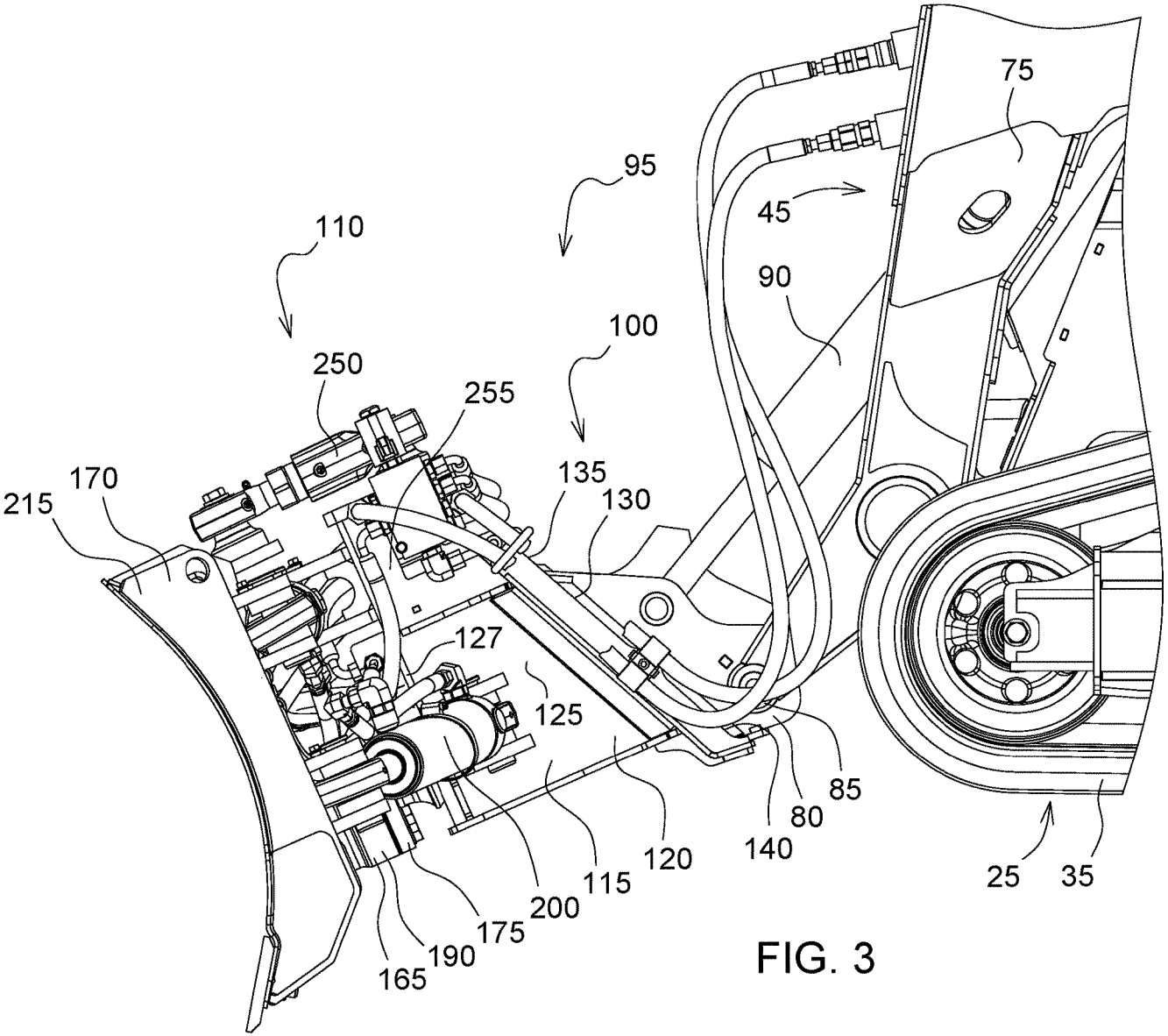
FIG. 3 is a zoomed in partial side view of the work vehicle of FIG. 1.
Figure 4:
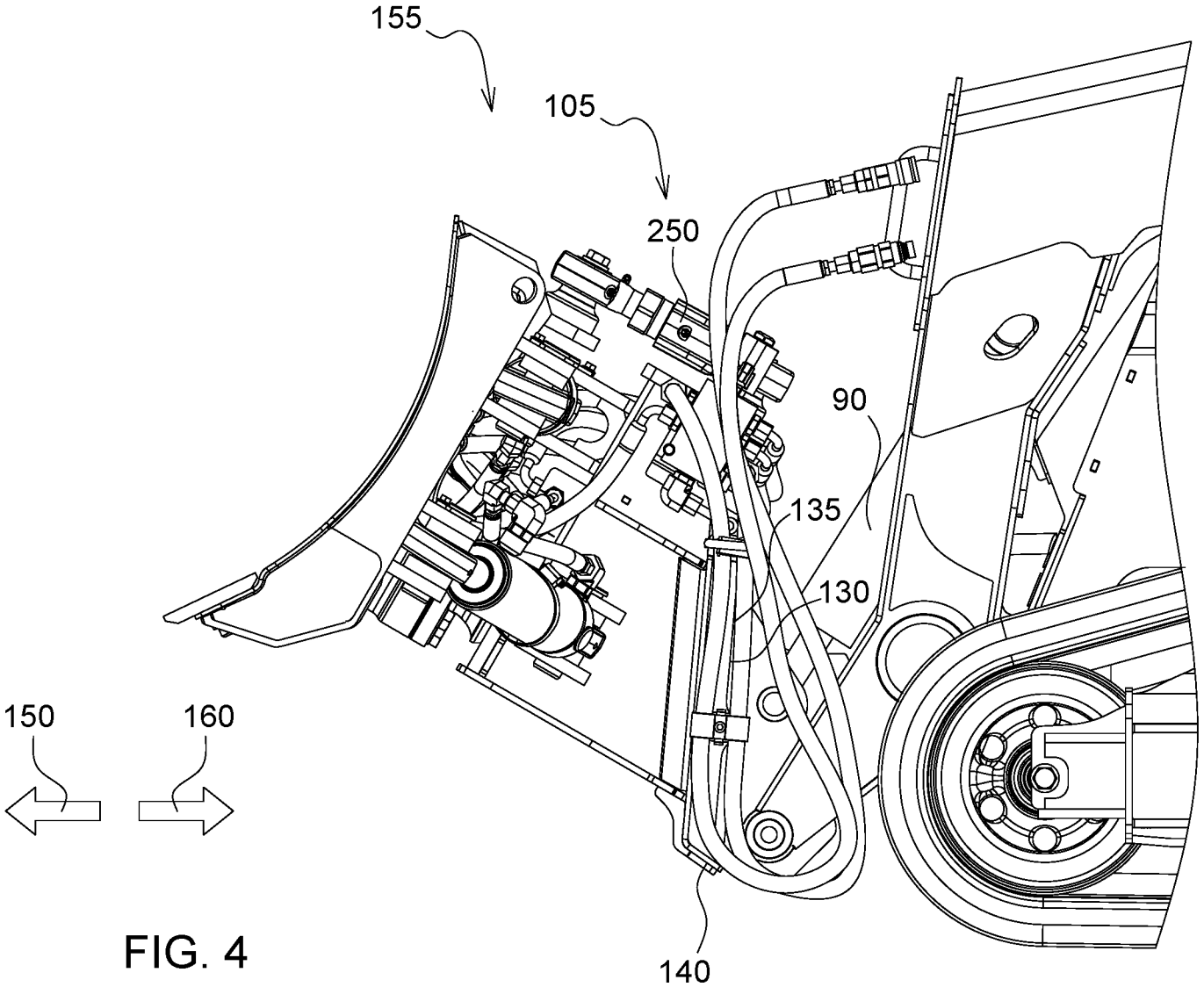
FIG. 4 is a zoomed in partial side view of the work vehicle of FIG. 1.

Referring to FIG. 2, an attachment coupler 80 is coupled to a distal portion 85 of the boom assembly 45. At least one tilt cylinder 90 is coupled to the boom assembly 45 and the attachment coupler 80 and configured to move the attachment coupler 80. The tilt cylinder 90 may be a hydraulic actuator 92 or an electronic actuator 94. The tilt cylinder 90 has a fully extended position 95 (FIG. 3), a mid-stroke position 100, and a fully retracted position 105 (FIG. 4).

With continued reference to FIG. 2, an attachment 110 is coupled to the attachment coupler 80. The attachment 110 comprises an attachment frame 115 coupled to the attachment coupler 80. The attachment frame 115 has a lower portion 120, an upper portion 125, a forward surface 127, and a trailing surface 130. The trailing surface 130 has a top half 135 and a bottom half 140. In an operating position 145 of the attachment 110 the trailing surface 130 is angled forward 150, or towards the direction of forward travel, with the top half 135 positioned forward 150 of the bottom half 140. This helps to improve the attachment 110 lift height when the tilt cylinder 90 is in the fully retracted position 105 because the tilt cylinder 90 has more travel from the more extended mid-stroke position 100 to the fully retracted position 105. Referring to FIG. 4, in a raised position 155 of the attachment 110 the trailing surface 130 is angled backward 160, or towards the direction of reverse travel, with the bottom half 140 of the trailing surface 130 positioned forward 150 of the top half 135.

Figure 5:
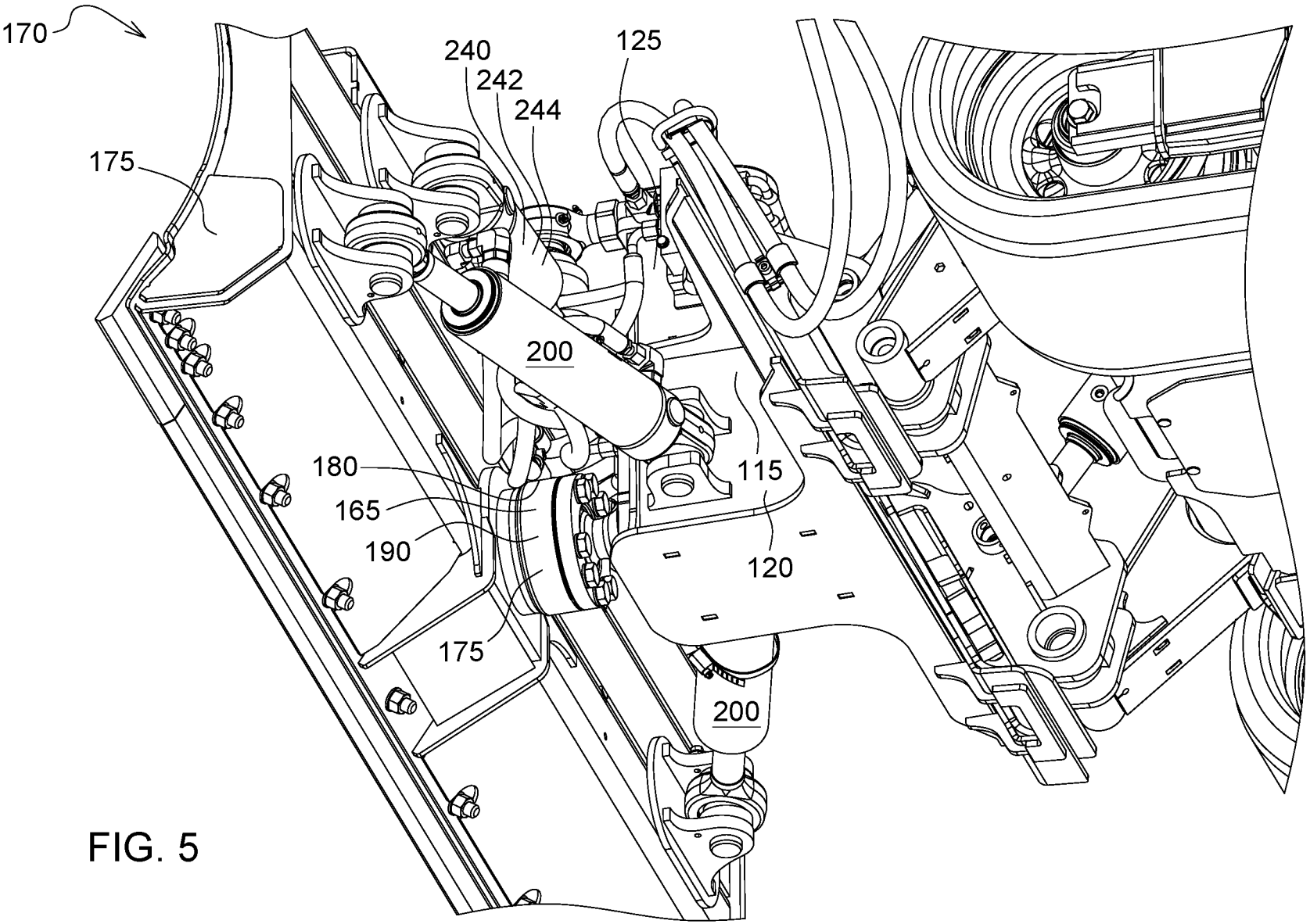
FIG. 5 is a zoomed in bottom perspective view of a portion of the work vehicle of FIG. 1.

With reference to FIG. 5, a joint 165 is coupled to the lower portion 120 of the attachment frame 115 and a blade 170. The joint 165 has a lower surface 175 and an upper surface 180. Referring to FIG. 2, the lower surface 175 is positioned a distance 185 from the surface 30.

With continued reference to FIG. 2, the joint 165 may be a ball joint 190. The joint 165 may be coupled to the blade 170 at a first axis of rotation 195 and at least one angle cylinder 200 may be coupled to the blade 170 at a second axis of rotation 205. The angle cylinder 200 may be a hydraulic actuator 202 or an electronic actuator 204. The second axis of rotation 205 may lie in a first plane 210 (FIG. 1). The first axis of rotation 195 and the second axis of rotation 205 may intersect at or near the center of the joint 165. The first axis of rotation 195 may be perpendicular to the second axis of rotation 205.

The blade 170 may be a dozer blade 215. The dozer blade 215 may have the operating position 145 where the tilt cylinder 90 is in the mid-stroke position 100 and the raised position 155 (FIG. 4) where the tilt cylinder 90 is in the fully retracted position 105.

Referring to FIG. 2, the angle cylinder 200 may be coupled to the lower portion 120 of the attachment frame 115 and the blade 170. A portion 225 of the angle cylinder 200 may be positioned below the upper surface 180 (FIG. 5) of the joint 165.

A horizontal joint centerline 230 of the joint 165 may be offset 37 mm or less from a horizontal angle cylinder centerline 235 of the angle cylinder 200. Advantageously, this helps to reduce cross-functional interactions such as unwanted blade 170 tilt during angle movement, for example, which improves the precision of controlling grade of the surface 30 with less passes of the work vehicle 10. Alternatively, the angle cylinder 200 may be positioned such that the horizontal angle cylinder centerline 235 and the horizontal joint centerline 230 are coincident lines with no offset (not shown) to reduce cross-functional interactions.

With reference to FIG. 5, a blade tilt cylinder 240 may be coupled to the upper portion 125 of the attachment frame 115. The blade tilt cylinder 240 may be a hydraulic actuator 242 or an electronic actuator 244. Referring to FIG. 2, the blade tilt cylinder 240 may be coupled to the blade 170 at a third axis of rotation 245 that lies in the first plane 210 (FIG. 1). The blade tilt cylinder 240 is configured to tilt the a side of the blade 170 in an upward or downward direction.

An adjustable linkage 250 may be coupled to the upper portion 125 of the attachment frame 115. The adjustable linkage 250 may include threads 252 for manual adjustment. Alternatively, the adjustable linkage 250 may be a hydraulic actuator 253 or an electronic actuator 254. The adjustable linkage 250 may be coupled to the blade 170 at a fourth axis of rotation 255 that lies in a second plane 260 (FIG. 1) that is forward 150 of and parallel to the first plane 210. The first plane 210 and the second plane 260 may be offset by 30 mm or less in order to reduce cross-functional interactions.

Figure 6:
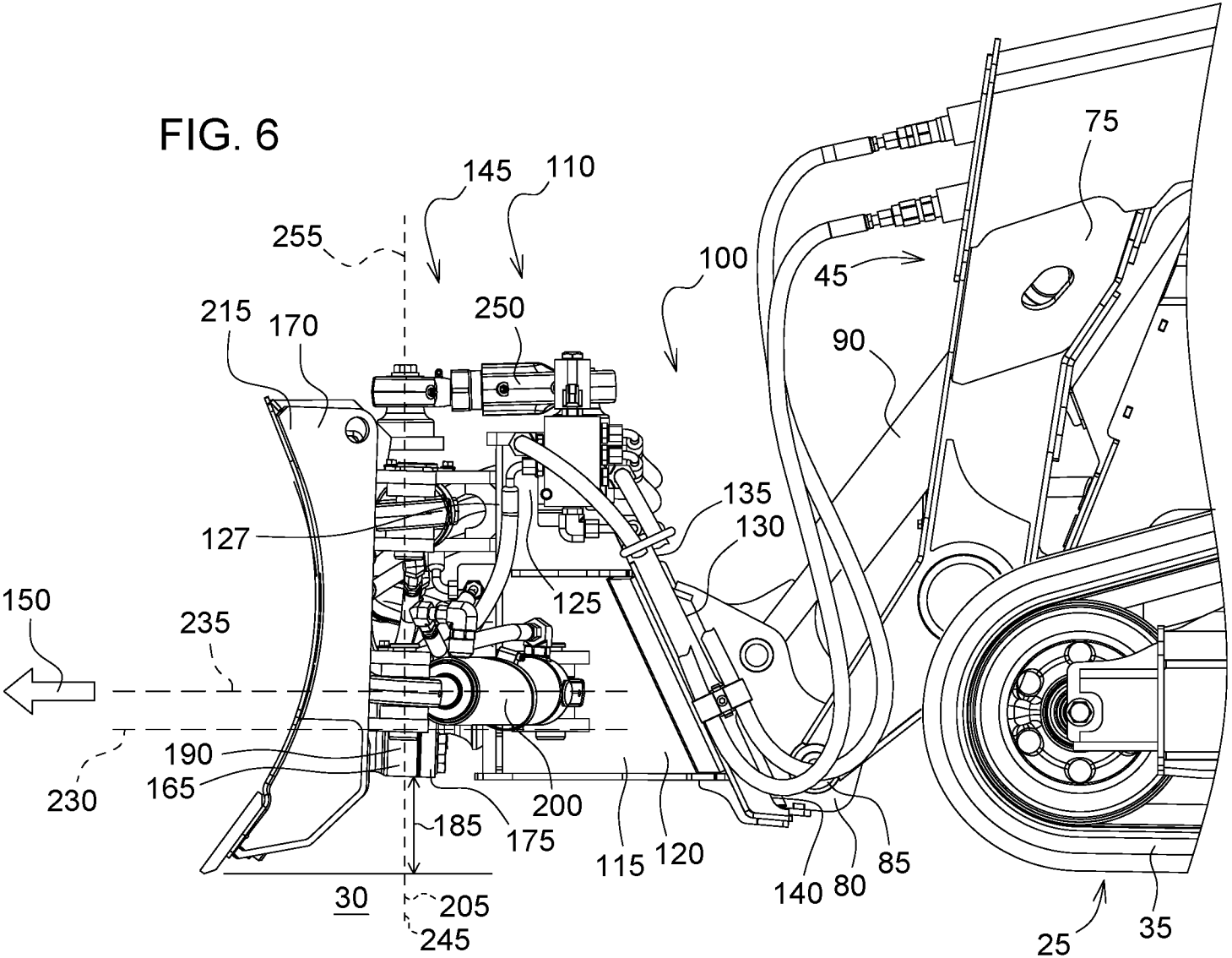
FIG. 6 is a zoomed in partial side view of the work vehicle according to another embodiment.

Referring to FIG. 6, alternatively, the adjustable linkage 250 may be coupled to the blade 170 at the fourth axis of rotation 255 that lies in the first plane 210. The adjustable linkage 250 may extend partially or fully above the blade 170.

What is claimed is:

1. A work vehicle comprising:

a frame;

at least one ground engaging device coupled to the frame and configured to support the frame above a surface;

a boom assembly coupled to the frame;

at least one boom cylinder coupled to the frame and the boom assembly and configured to move the boom assembly;

an attachment coupler coupled to a distal portion of the boom assembly;

at least one tilt cylinder coupled to the boom assembly and the attachment coupler and configured to move the attachment coupler;

an attachment coupled to the attachment coupler, the attachment comprising:

an attachment frame coupled to the attachment coupler, the attachment frame having a lower portion and an upper portion;

a blade;

a joint coupled to the lower portion of the attachment frame and the blade, the joint having a lower surface and an upper surface, the lower surface positioned a distance from the upper surface; and at least one angle cylinder coupled to the lower portion of the attachment frame and the blade, a portion of the angle cylinder positioned below the upper surface of the joint, wherein the joint is coupled to the blade at a first axis of rotation and the angle cylinder is coupled to the blade at a second axis of rotation and the first axis and the second axis intersect at a center of the joint.

2. The work vehicle of claim 1, further comprising a blade tilt cylinder coupled to the upper portion of the attachment frame, the blade tilt cylinder is coupled to the blade at a third axis of rotation that lies in a first plane.

3. The work vehicle of claim 2, further comprising an adjustable linkage coupled to the upper portion of the attachment frame, the adjustable linkage is coupled to the blade at a fourth axis of rotation that lies in a second plane that is parallel to the first plane.

4. The work vehicle of claim 2, further comprising an adjustable linkage coupled to the upper portion of the attachment frame, the adjustable linkage is coupled to the blade at a fourth axis of rotation that lies in the first plane.

5. The work vehicle of claim 3, wherein the first plane and the second plane are offset by 30 mm or less.

6. The work vehicle of claim 1, wherein a horizontal joint centerline is offset 37 mm or less from a horizontal angle cylinder centerline.

7. The work vehicle of claim 1, wherein the joint is a ball joint.

8. The work vehicle of claim 1, wherein the blade is a dozer blade.

9. The work vehicle of claim 1, wherein the work vehicle is a compact track loader.

10. The work vehicle of claim 3, wherein the adjustable linkage extends above the blade.

11. A compact track loader comprising:

a frame;

at least one ground engaging device coupled to the frame and configured to support the frame above a surface;

a boom assembly coupled to the frame;

at least one boom cylinder coupled to the frame and the boom assembly and configured to move the boom assembly;

an attachment coupler coupled to a distal portion of the boom assembly;

at least one tilt cylinder coupled to the boom assembly and the attachment coupler and configured to move the attachment coupler;

an attachment coupled to the attachment coupler, the attachment comprising:

an attachment frame coupled to the attachment coupler, the attachment frame having a lower portion and an upper portion;

a dozer blade;

a joint coupled to the lower portion of the attachment frame and the dozer blade, the joint having a lower surface and an upper surface, the lower surface positioned a distance from the surface; and at least one angle cylinder coupled to the lower portion of the attachment frame and the dozer blade, a portion of the angle cylinder positioned below the upper surface of the joint, wherein the joint is coupled to the dozer blade at a first axis of rotation and in a first plane and the angle cylinder is coupled to the dozer blade at a second axis of rotation and the first axis and the second axis intersect at a center of the joint.

12. The compact track loader of claim 11, further comprising a blade tilt cylinder coupled to the upper portion of the attachment frame, the blade tilt cylinder is coupled to the dozer blade at a third axis of rotation that lies in the first plane.

13. The compact track loader of claim 12, further comprising an adjustable linkage coupled to the upper portion of the attachment frame, the adjustable linkage is coupled to the dozer blade at a fourth axis of rotation that lies in a second plane that is parallel to the first plane.

14. The compact track loader of claim 12, further comprising an adjustable linkage coupled to the upper portion of the attachment frame, the adjustable linkage is coupled to the dozer blade at a fourth axis of rotation that lies in the first plane.

15. The compact track loader of claim 13, wherein the first plane and the second plane are offset by 30 mm or less.

16. The compact track loader of claim 11, wherein a horizontal joint centerline is offset 37 mm or less from a horizontal angle cylinder centerline.

17. The compact track loader of claim 13, wherein the adjustable linkage extends above the dozer blade.

* * * * *